US011109678B2

(12) United States Patent
Zhu

(10) Patent No.: US 11,109,678 B2
(45) Date of Patent: Sep. 7, 2021

(54) COLLAPSIBLE HANGING SHELF

(71) Applicant: Shou Qiang Zhu, Ontario, CA (US)

(72) Inventor: Shou Qiang Zhu, Ontario, CA (US)

(73) Assignee: IP POWER HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 16/575,040

(22) Filed: Sep. 18, 2019

(65) Prior Publication Data

US 2021/0076822 A1 Mar. 18, 2021

(51) Int. Cl.

| | |
|---|---|
| ***A47B 96/02*** | (2006.01) |
| ***A47B 96/16*** | (2006.01) |
| ***A47B 43/00*** | (2006.01) |
| *A47B 96/06* | (2006.01) |

(52) U.S. Cl.

CPC ..... *A47B 96/025* (2013.01); *A47B 43/003* (2013.01); *A47B 96/16* (2013.01); *A47B 96/063* (2013.01)

(58) Field of Classification Search

CPC ..... A47B 96/025; A47B 43/003; A47B 96/16; A47B 96/063; A47B 3/02; A47B 43/00; F16M 11/38; D06F 57/06

See application file for complete search history.

(56) References Cited

U.S. PATENT DOCUMENTS 188,266 A * 3/1877 Stead ..... E06C 5/28 182/69.3
988,927 A * 4/1911 Canham ..... A41H 5/01 223/68
999,126 A * 7/1911 Sistermann ..... B66F 11/042 182/69.5
1,203,545 A * 10/1916 Moore ..... B62B 3/02 280/43.16
1,769,140 A * 7/1930 Kaufman ..... A47B 43/00 211/202
1,814,838 A * 7/1931 Martin ..... A47B 3/02 108/99
1,955,769 A * 4/1934 Reynolds ..... G09F 5/02 211/130.1
2,530,231 A * 11/1950 Detweiler ..... A47F 5/108 294/161
2,628,011 A * 2/1953 Buechler ..... E06C 7/488 182/164
2,641,247 A * 6/1953 Genebach ..... F24C 15/16 126/337 A (Continued)

*Primary Examiner* — Ko H Chan

(74) *Attorney, Agent, or Firm* — Che-Yang Chen; Law Office of Michael Chen

(57) ABSTRACT

A collapsible hanging shelf may include a plurality of shelf members and a hanging member. A shelf member includes more than one parallel placed connecting units and a shelf. A connecting unit include one pair of crossing bars and a control bar that connecting a shelf and one of the pair bar. A shelf member connected with at least two connecting units at the points of one end of the control bar and the cross point of crossing bars. Each shelf is placed with other shelf in a vertically parallel manner. Once the hanging shelf is hung on the door, it can be pulled down by gravity and stopped at a fully extended position without applying any external forces. When it is taken off from the door and put it on the ground, the shelf can be quickly collapsed into a space saving position under the control of gravity.

3 Claims, 7 Drawing Sheets

(56) References Cited

U.S. PATENT DOCUMENTS

| | | | | | |
|---|---|---|---|---|---|
| 2,927,702 | A * | 3/1960 | Van Deusen, Jr. | A47B 3/02 | 108/96 |
| 3,034,765 | A * | 5/1962 | Ludowici | B66F 3/22 | 254/122 |
| 3,315,762 | A * | 4/1967 | Torrey | E06C 1/56 | 182/164 |
| 5,207,333 | A * | 5/1993 | Peng | A47B 43/00 | 187/211 |
| 5,285,992 | A * | 2/1994 | Brown | B66F 7/0608 | 108/147 |
| 6,701,852 | B2 * | 3/2004 | Sedge | B65D 19/12 | 108/53.3 |
| D547,093 | S * | 7/2007 | Butters | D6/566 | |
| D750,889 | S * | 3/2016 | Fortney | D3/260 | |
| 9,668,600 | B1 * | 6/2017 | Lau | A47J 47/14 | |
| 10,527,221 | B2 * | 1/2020 | Grappe | B62B 3/02 | |
| 2017/0119152 | A1 * | 5/2017 | Zhu | A47B 61/04 | |
| 2017/0251808 | A1 * | 9/2017 | Ruiz | A47B 43/04 | |

* cited by examiner

COLLAPSIBLE HANGING SHELF

FIELD OF THE INVENTION

The present invention is directed to a hanging shelf, and in particular to a collapsible hanging shelf, the size of which can be easily minimized when not in use.

BACKGROUND OF THE INVENTION

In home decor, household storage spaces can largely expend by using the space at the back of a household door. One of a popular way in household door expanding is a collapsible hanging shelf which can attach to the top of the door. In modern lives, numerals of people live in very small space or just rent a place for living. Usually, people don't have such luxury to own enough room to place a solid shelf for item storage purpose. Though plenty of alternative door hanging shelfs have been developed, many of them still have limitations so that the market demands further innovation. More specifically, many of the current product choose adhesive hooks or stickers to attach the appliance to a door. The weight-bearing limitation for storage of an appliance is limited by the sticky level of paint that covers the door. Also, the hanging shelf may be a firm structure that takes a space no matter it is in use or not, which could be a waste of space for space sensitive users or causes a trouble during transportation. A design that can bear a higher weight and collapse into significantly smaller size would be a better solution to for users. Therefore, there is a need for a new and improved hanging shelf to overcome the problems stated above.

SUMMARY OF THE INVENTION

It is an object of the present invention to provide a collapsible hanging shelf that can be stored and transported more conveniently and efficiently without putting any additional or unnecessary burden to users.

It is another object of the present invention to provide a collapsible hanging shelf which can be pulled down and extended by gravity when in use without applying other external forces.

It is another object of the present invention to provide a collapsible hanging shelf which can bear large weight items.

It is a further object of the present invention to provide a collapsible hanging shelf, which can be quickly collapsed on the ground, and the size of which can be significantly reduced.

In one aspect, a collapsible hanging shelf may include a plurality of shelf members and a hanging member. A shelf member include at least two parallel placed connecting units and a shelf. A connecting unit include a pair of crossing bars and a control bar that connecting the shelf and one of the crossing bar. A shelf member connected with at more than one connecting units. Each shelf is placed with other shelf in a vertically paralleled manner. Once the hanging shelf is hung on the door, it can be pulled down by gravity and stopped at fully extended position without applying any external forces. When it is taken off from the door and put it on the ground, the shelf can be quickly collapsed into space saving position under the control of gravity.

Each connecting unit include a pair of crossing placed bars and a control bar. One connecting units have one bar parallel to a bar in every other units, and the other bar of this connecting units parallel to the other bar of every other units.

When the hanging shelf is collapsed, the size of the hanging shelf can be significantly reduced, because every sets of paralleled bars in connection units stacked up and the shelfs stake together. So that the whole body can occupy the smallest space.

It is important to note that the connection units of the hang shelf is resilient, more or less like a spring. When the shelf is hung on the door, it can be pulled down by gravity and stop extension at fully extended position with the help of its control bar. All such process do not need to apply any external forces. On the other hand, when it is taken off from the door and put onto the ground, the hanging shelf is working very much like a spring, and can be quickly collapsed by the force of the gravity.

DETAILED DESCRIPTION OF THE INVENTION

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
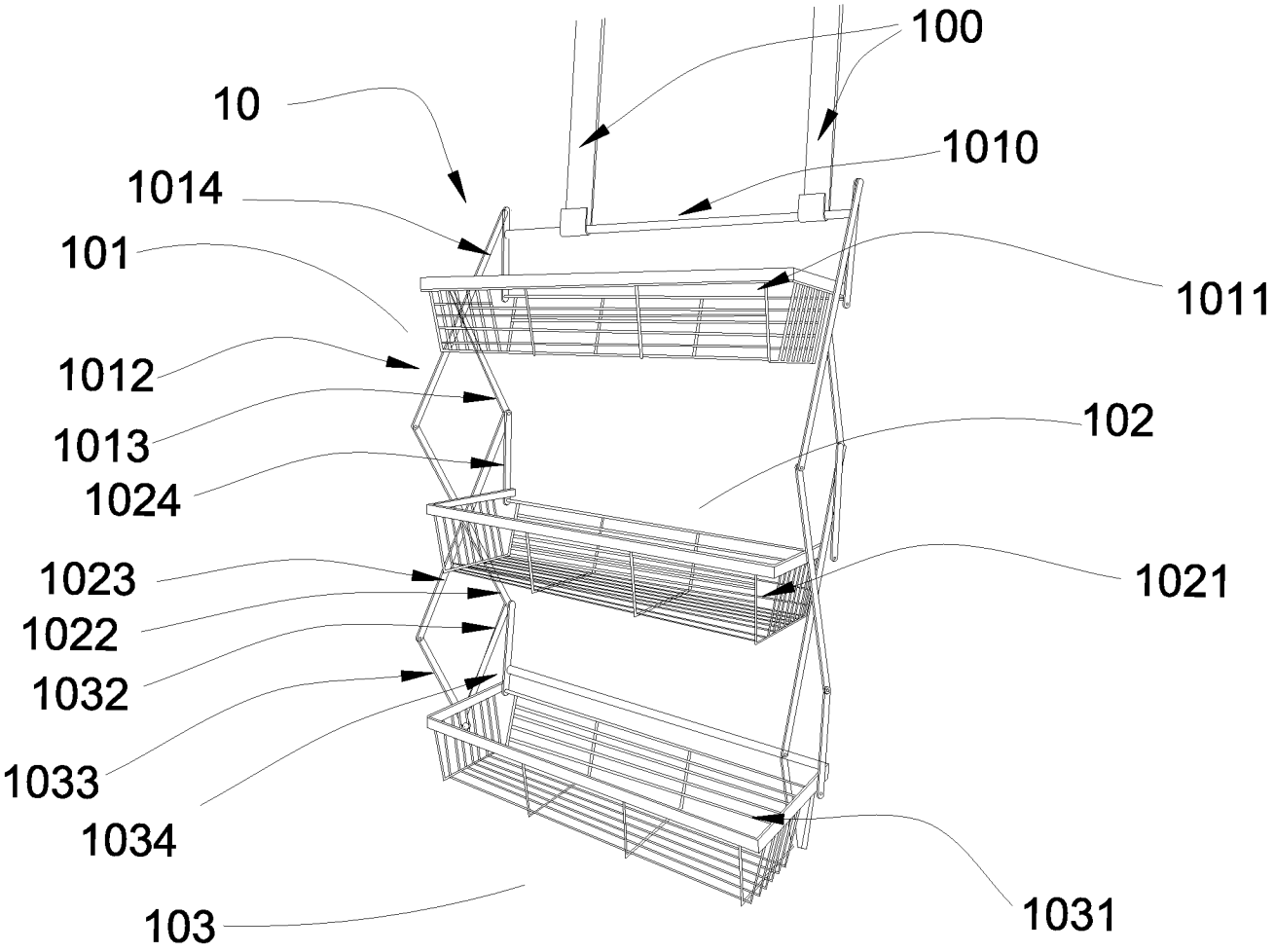
FIG. 1 illustrates a perspective view of the collapsible hanging shelf in the present invention.
Figure 2:
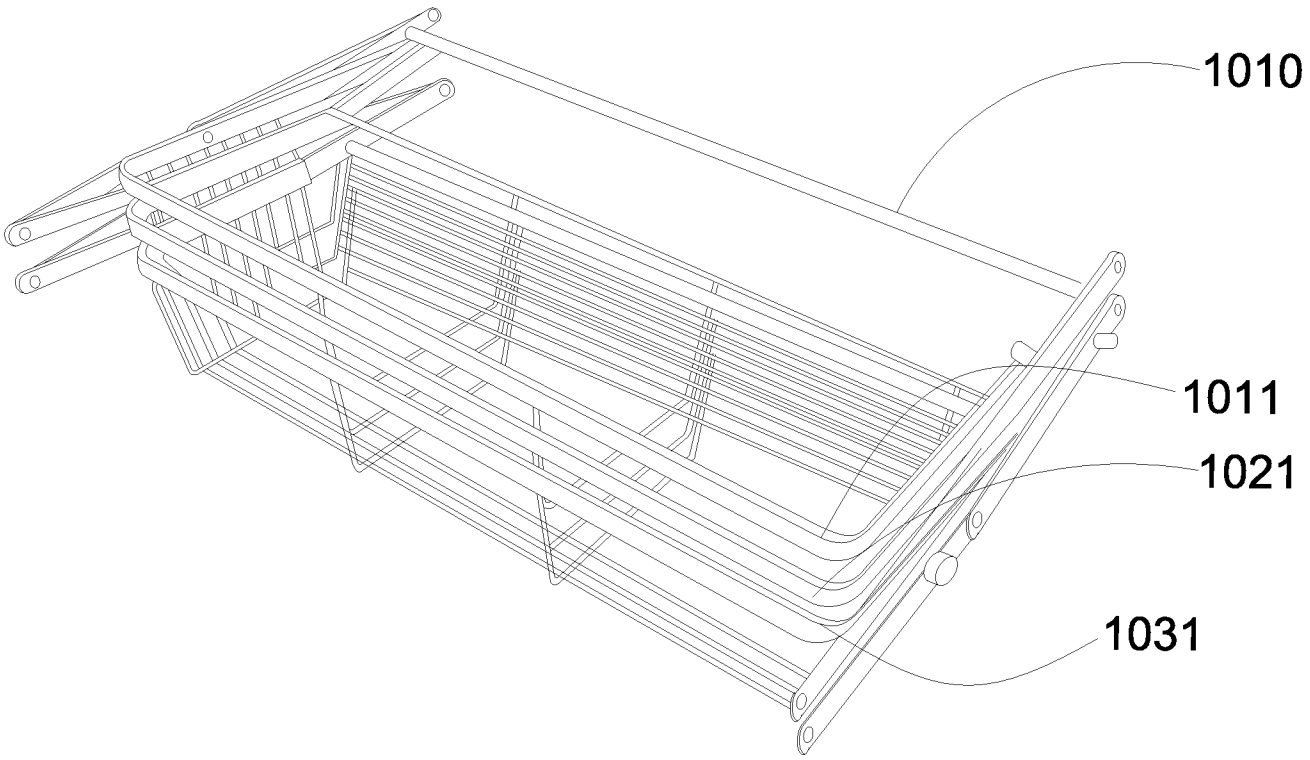
FIG. 2 illustrates a schematic view of the collapsible hanging shelf in the present invention when it is totally collapsed.
Figure 3:
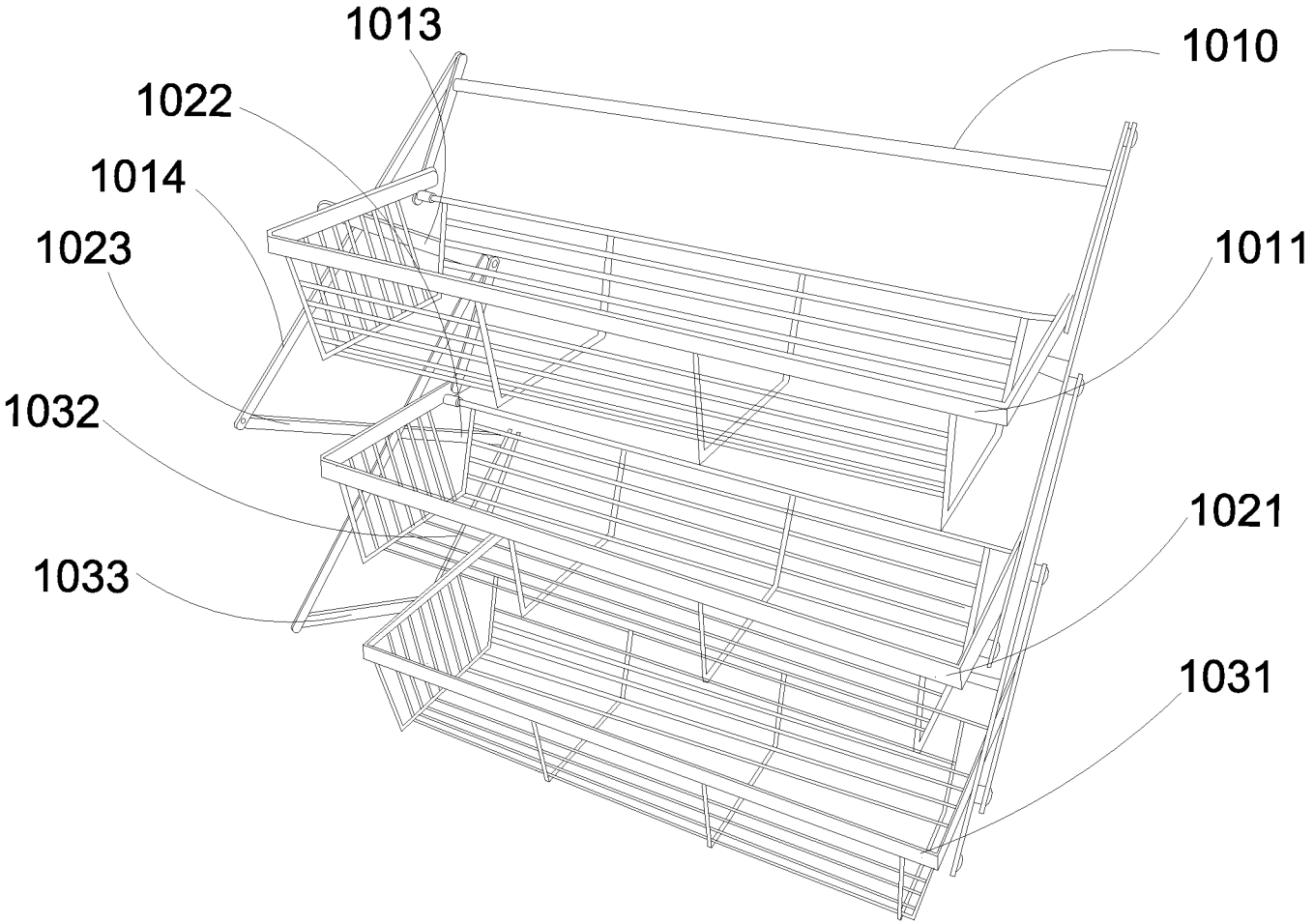
FIG. 3 illustrates a schematic view of the collapsible hanging shelf in the present invention when it is partially collapsed.
Figure 4:
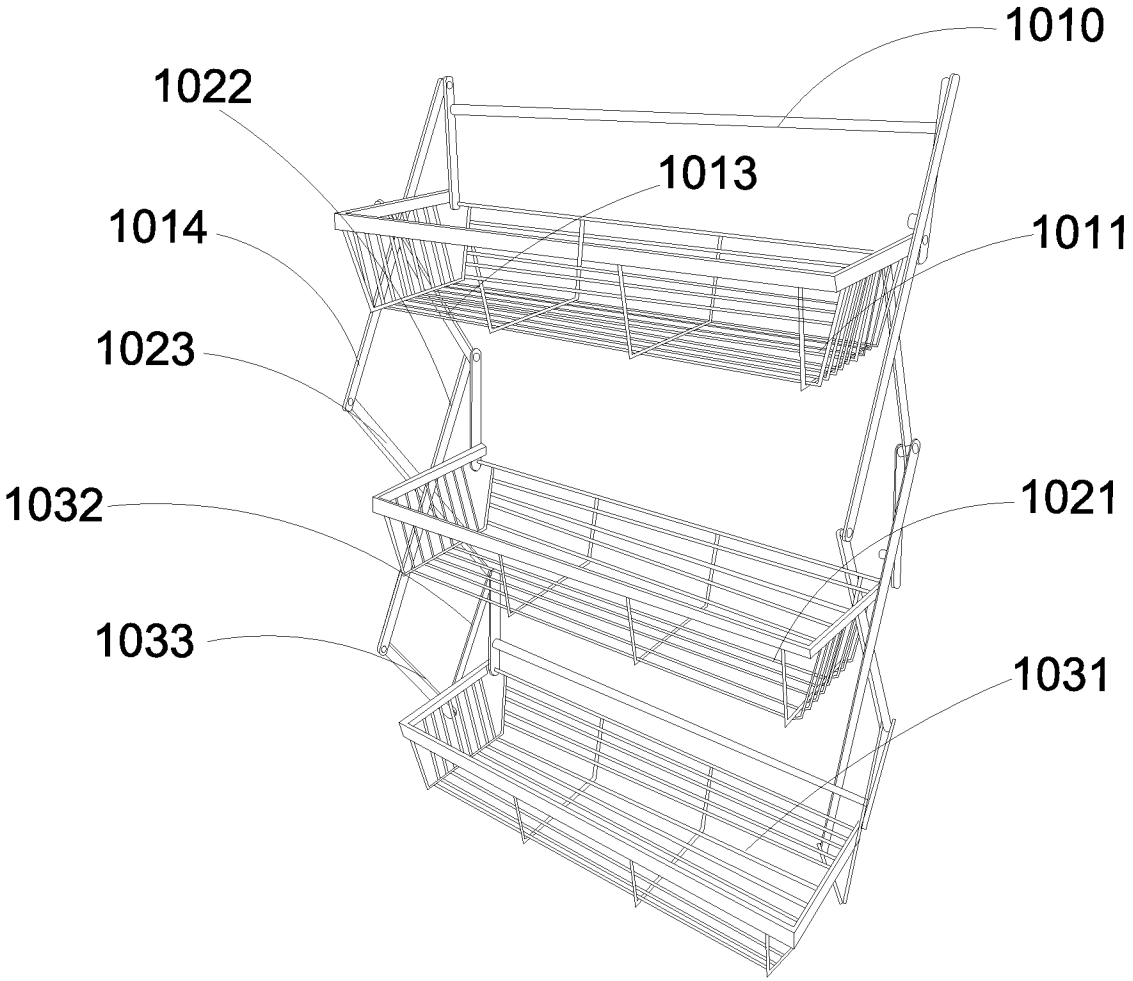
FIG. 4 illustrates a schematic view of the collapsible hanging shelf in the present invention when it is taken off from the door

In order to further understand the goal, characteristics and effect of the present invention, a number of embodiments along with example drawings of a 3-level hanging shelf are illustrated as following:

In one aspect, referring to FIG. 1, a collapsible hanging shelf 10 may include a plurality of shelf members (101, 102, 103) and a hanging member 100. Shelf member 101 include at least two parallel placed connecting members and a shelf 1011. A connecting member includes a pair of crossing bars 1012, 1013 and a control bar 1014 that connecting a shelf and one of the crossing bar. A shelf 1011 connected with at least two connecting units at several points. The connect point including one end point of the control bar and the cross point of crossing bars. Shelf 1011 is placed with other shelf 1021, 1031 in a vertically parallel manner. Once the hanging shelf 10 is hung on the door, it can be pulled down by gravity and stopped at fully extended position controlled by control bar 1014 as shown in FIG. 3 and FIG. 4. When the hanging member 100 is taken off from the door and put it onto the ground, the shelf can be quickly collapsed into space saving position under the control of gravity as shown at FIG. 2. One connecting member has bar 1012 parallel to bar 1023, 1032, 1012', 1023', 1032' in other units, and the other bar 1013 of this connecting member parallel to the other bar 1022, 1033, 1022', 1033' of other units. Notably, control bars 1014, 1014', 1024, 1024', 1034 and 1034' parallel to each other as well. When the hang shelf 10 is collapsed, the size of the hanging shelf 10 can be significantly reduced because set of paralleled bars 1022, 1033, 1022', 1033 and set of paralleled bars 1014, 1014', 1024, 1024', 1034 and set of paralleled bars 1023, 1032, 1012', 1023', 1032' stacked up independently, In the meantime, the shelfs 1011, 1021, 1031 stack together as well. Then, the whole body can occupy the smallest space.

In one embodiment, shelf members including a top shelf member 101, a bottom shelf member 103 and a plurality of middle shelf 102 member. Notably, the middle shelf member can be replaced by the bottom member and the hanging shelf 10 may turn to be a 2-level storage shelf.

The hanging member 100 including at least one U-shape hanging bar. Each hanging bar have at least one hook in one of its ends. The U-shape curve from side view would firmly lock the whole embodiment to the household door. The hooks may access and support the shelf member underneath.

Figure 6:
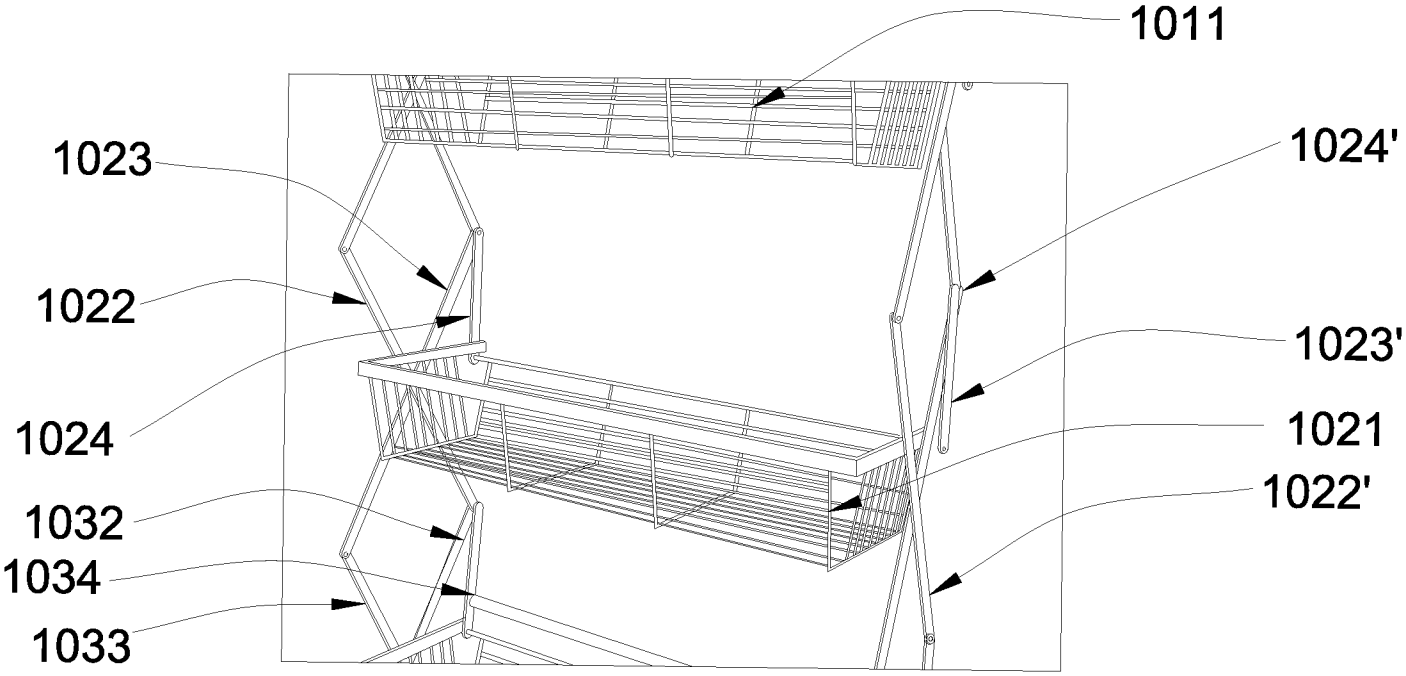
FIG. 6 illustrates a schematic view of a middle portion of the collapsible hanging shelf in the present invention.

In one embodiment, the shelf members connect each other by connect their connect units with each other. To be specifically, when embodiment have no less than three level, as shown in FIG. 1, we take the middle shelf member 102 as an example. As shown in FIGS. 1 and 6, middle shelf member 102 have two parallel placed connect units 1022, 1023, 1024 and 1022', 1023', 1024'. 1022 with 1023 and 1022' with 1023' are 2 pair of crossing bars. They have a same length and the cross connect point should be exactly at the center of each bar. Control bar 1024 have one end connect to upper end of the pair bar 1023. The shelf 1021 connects to connecting members at one of the pair bars 1023, 1023' or 1022 and 1022' and the free end of the control bar 1024, 1024'. Notably, the two connecting points within a single connecting member should not be in the same place. Shelf member 101 connect with an upper shelf member 101 and a lower shelf member 103. For 102, the upper free end of pair bar 1023 connects to lower free end of bar 1013 in upper shelf 101 and the other upper free end of this pair bar 2022 connects to the lower free end of bar 1012 in upper shelf 101. For the lower free end of 1023 and 1022, the lower free end of 1022 connects to the upper free end of 1032 in the lower shelf 103 and the lower free end of 1023 connects to the upper free end of 1033 in the lower shelf 103. The other connecting member in 102 connect the upper and lower shelf the same way as described above.

Notably, the connection of control bar 1024 and the pair bar may be one of the four end of the bar pair, as long as all shelf members in the embodiment share the same arrangement.

Figure 5:
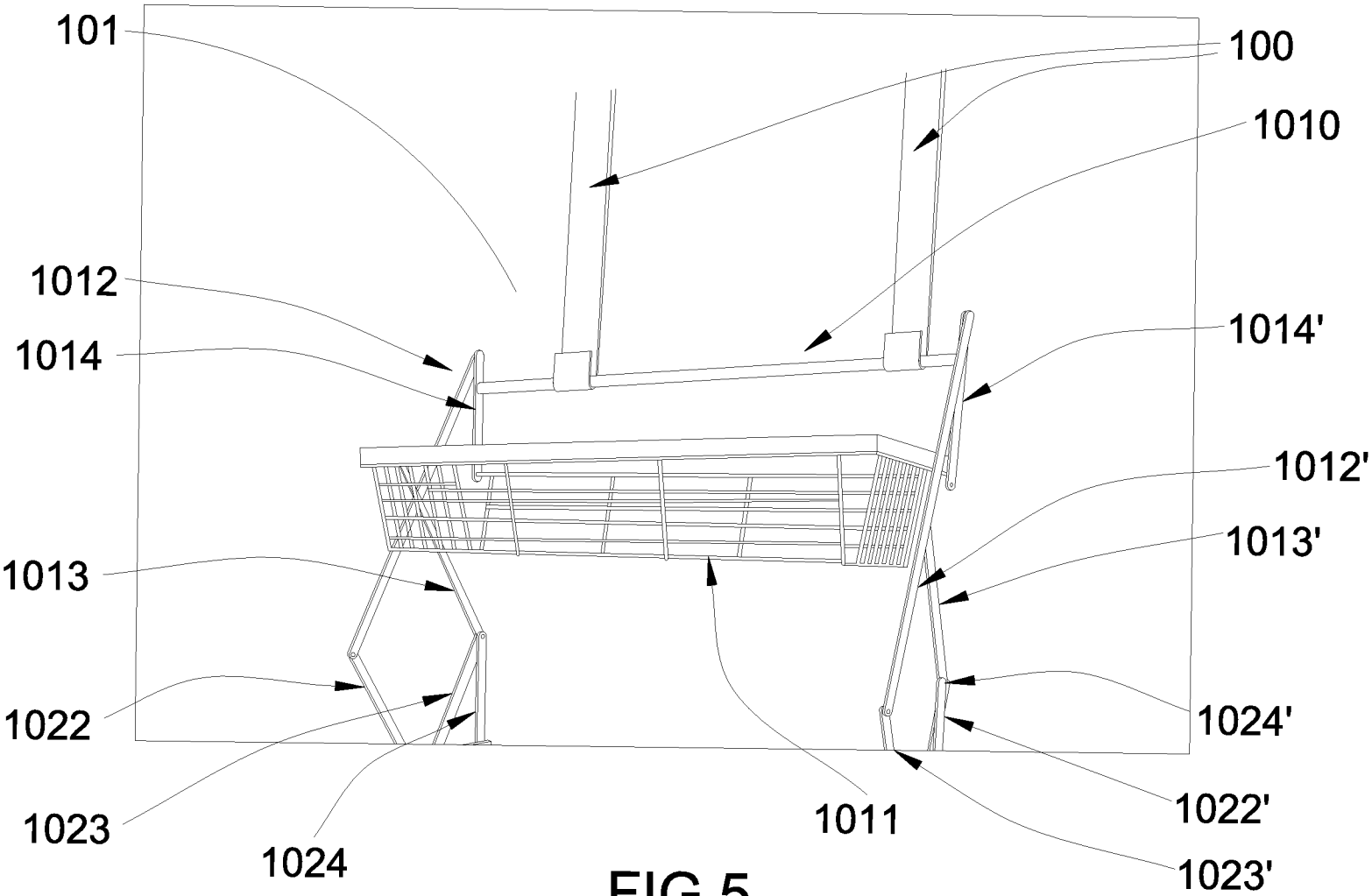
FIG. 5 illustrates a schematic view of the top portion of the collapsible hanging shelf in the present invention.
Figure 7:
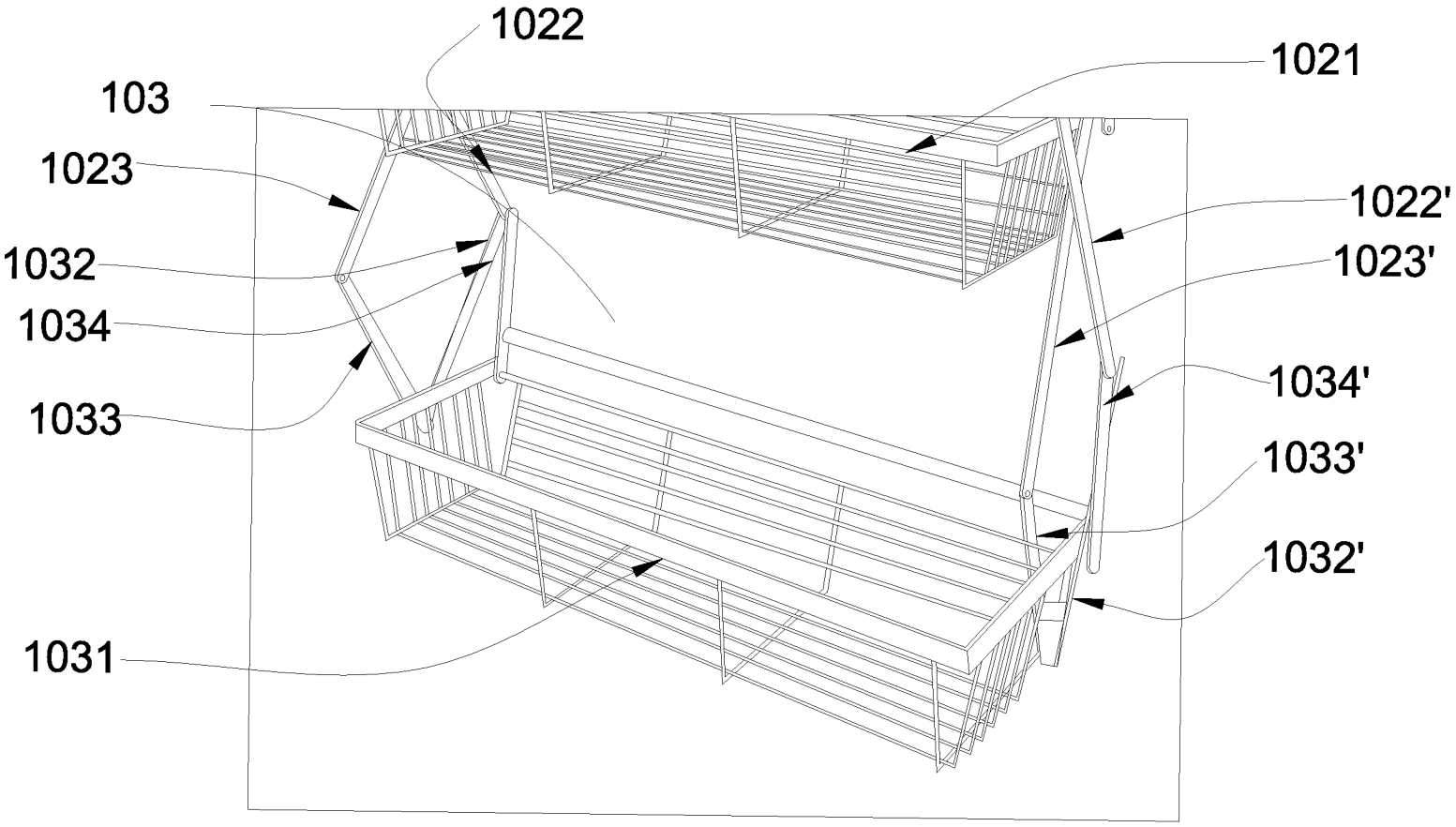
FIG. 7 illustrates a schematic view of the bottom portion of the collapsible hanging shelf in the present invention.

Specially, the top shelf member 101 and bottom shelf member 103 of the embodiment have a structure slightly different from middle shelf members 102. The connection point at one of the bar pair don not have to be the center point of that bar. To be specifically, referring FIG. 5, the control bars 1014, 1014' of the top shelf member 101 both firmly attached to a horizontal holding bar 1010. Such connection is preferably made by welding and other firm enough methods are acceptable. Holding bar 1010 is weight bearing bar that hooked by the hooks of hanging bar 100. Whole weight of embodiment 10 would apply to the holding bar 1010 and transported to the hanging bars. One other difference in the top shelf member 101 is that the shelf 1011 accessible bars in the bar pairs may be slightly shorter than the other bar in this pair. As for the bottom shelf member, referred in FIG. 7, the connecting member could reduce its length at the lower half.

The control bar in connection unit works as an extension limitation control part. As shown in FIGS. 1 to 3, in the fully extension position, the control bar is fully downward and it is in a position paralleled to the door. The control bar is much shorter than other bars. In cooperation with the lengths of other bars of the connection unit, the shelf in the shelf member is horizontally placed in the fully opened position of the hanging shelf. In the fully closed position, the control bar is paralleled with one of other bars in its connection unit. During the open or close process, the control bar will spin in accordance to the move of the crossing bars. When the connection unit reach its fully opened position, the control bar reach its vertical position and do not able to spin further or back. So that, the crossing bars will hold by the control bar and stop any further extension beyond the fully opened position.

The shelf is a basket or box with a shape that can be stack up together. Preferably, shelf may be molded to Frustum of a Square Pyramid liking shape, yet other stackable shape are acceptable.

Notably, the connection units are like springs, and the basket is able to stack. More or less, the whole embodiment likes a spring. When the hanging shelf is hung on the door, the gravity will pull it down open. Yet, the control bar maintains the fully opened position from further extension. Still with the help of gravity, when the hanging shelf is taken off from the door and put it on the ground, the hanging shelf 10 is very much like spring and the gravity will make it collapse.

More specifically, the hanging shelf 10 in the present invention has a symmetric structure and basically includes a plurality of shelf members 102. A shelf member 102 include two connection units and a shelf 1021. A connection unit works as a spring. It includes a pair of cross placed bars 1023, 1022 and a control bar 1024. The whole embodiment 10 is driven to open or close solely by gravity, but limited by control bars. Whereas, when the hanging shelf 10 is just removed from the door and put on the ground, all a user needs to do is take control of the pace and location of the collapsed process, so that the hanging shelf can be collapsed properly. Namely, when the hanging shelf is not in use, it can be totally collapsed as shown in FIG. 2 and it becomes very easy to store and transport because the size thereof is significantly reduced.

On the other hand, if the user wants to use the hanging shelf 10 again, it can be easily restored from totally collapsed (FIG. 2) to substantially extended (FIG. 1) when the user hangs the hanging shelf 10 back to the door.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A collapsible hanging shelf assembly comprising: a plurality of shelves including a top shelf and one or more subsequent lower shelves arranged in a vertical manner, each shelf of the plurality of shelves includes a bottom and side walls extending upwardly around the peripilery of the bottom; a first horizontal holding bar, and a second horizontal holding bar; a pair of connecting members on two opposite sides of the shelves; and a pair of first set of control bars extending vertically and upwardly from both sides of the top shelf; each control bar of the first set of control bars pivotally connected to one end of the first horizontal holding bar, wherein each of the connecting member includes a plurality of connecting bars to form one or more quadrilateral connecting structures pivotally connecting with each other, the collapsible hanging shelf assembly begins to collapse when each quadrilateral connecting structure pivots relative to each other, and the collapsible hanging shelf assembly fully collapses in a storage position when the quadrilateral connecting structures becomes a substantially linear structure wherein the top shelf and each of the subsequent lower shelves are nested within and stacked one on top of another; wherein at least a pair of second set of control bars extend vertically and upwardly from both sides of one of the lower shelf, and one end of each of the control bar of the second set of control bars is pivotally connected to the quadrilateral connecting structure, and the other end of each of the control bar of the second set of control bars is connected to the second horizontal holding bar.

2. The collapsible hanging shelf assembly of claim 1, wherein each shelf of the plurality of shelves is secured at a predetermined position at each side of the connecting member.

3. The collapsible hanging shelf assembly of claim 1, further comprising a hanging member to hang the hanging shelf assembly on a door.

* * * * *